United States Patent [19]

Hoelzer et al.

[11] 4,249,900

[45] Feb. 10, 1981

[54] DENTAL CONSOLE

[76] Inventors: E. Clyde Hoelzer, 2817 Maple La., Fairfax, Va. 22031; Ellis Magnuson, 340 Ayrhill Ave., Vienna, Va. 22180

[21] Appl. No.: 962,943

[22] Filed: Nov. 22, 1978

[51] Int. Cl.[3] ..... A61G 1/14; A61G 15/00

[52] U.S. Cl. ..... 433/79

[58] Field of Search ..... 32/22; 433/79

[56] References Cited

U.S. PATENT DOCUMENTS

| | | | |
|---|---|---|---|
| 3,530,513 | 9/1970 | Maurer et al. | 32/22 |
| 3,726,012 | 4/1973 | Grayson et al. | 433/79 |
| 3,762,051 | 10/1973 | Valesha | 433/79 |
| 3,986,263 | 10/1976 | Borgelt et al. | 32/22 |

*Primary Examiner*—Robert Peshock

*Attorney, Agent, or Firm*—Birch, Stewart, Kolasch & Birch

[57] ABSTRACT

The present invention is directed to a dental console which includes two support arms rotatably mounted on a common pedestal. Each support arm comprises a plurality of links which enable the support arms to be conveniently positioned relative to a dental chair in which a patient is seated. A first support arm includes a work tray with a plurality of power driven hand pieces and air and water syringes mounted thereon. A second support arm includes a cuspidor having various components, such as a syringe, evacuator, saliva ejector and air mounted thereon. The first support arm and second support arm may be easily rotated so as to position the work tray and cuspidor, respectively, on either the right-hand side or left-hand side of the dental chair. In this manner, the dental console of the present invention may be readily used by either a right-handed dentist or a left-handed dentist. Further, the dental console of the present invention may be readily positioned next to one of a plurality of dental chairs positioned about a centrally located pedestal of the dental console.

5 Claims, 4 Drawing Figures

DENTAL CONSOLE

BACKGROUND OF THE INVENTION

1. Field of the Invention

The present invention relates to a dental console wherein a work tray and a cuspidor may be readily positioned adjacent to a dental chair to enable the console to be used by either a right-handed or a left-handed dentist. Further, the work tray and the cuspidor of the present invention may be readily positioned adjacent to one of a plurality of dental chairs positioned around the dental console.

2. Description of the Prior Art

A conventional dental instrument unit is a fixed console usually mounted adjacent to the left-hand side of a dental chair. Such a dental instrument unit includes a cuspidor mounted adjacent to the console and a work tray which is mounted on an arm so as to be adjustable relative to the dental chair. This conventional dental instrument unit is satisfactory for use by a right-handed dentist. However, it is extremely difficult to utilize such a conventional dental instrument unit if the dentist is left-handed. Therefore, a serious inconvenience with a conventional dental instrument unit is the positioning of the unit adjacent to the left-hand side of a dental chair which forces left-handed dentists to learn to work right-handed. If a dentist continues to work left-handed with the unit positioned as discussed above he/she works in an extremely inconvenient and uncomfortable position.

The shortcomings of the conventional dental instrument unit are somewhat overcome by a specially adapted dental instrument unit designed to be positioned adjacent to the right-hand side of a dental chair. In this manner, the dental instrument unit may be readily utilized by a left-handed dentist. However, this arrangement is extremely difficult to be utilized by a right-handed dentist. Further, if the dental instrument unit is positioned in this manner, a left-handed dentist, wishing to increase his staff, must attempt to hire another left-handed dentist or be forced to purchase additional equipment designed for use by a right-handed dentist. This is a serious dilemma in view of the high cost of dental instrument units.

A dentist instrument unit which attempts to solve the problems discussed above is set forth in the Maurer et al patent, U.S. Pat. No. 3,530,513. The Maurer et al discloses a dental bowl support unit which is adapted to be mounted on a wall. The support unit includes two parallel bar members which carry a yoke having linear bearings. The yoke supports an arm which carries a dental bowl. In addition, the yoke supports an enclosure having the necessary plumbing facilities to supply the dental bowl with water and other necessary facilities.

Another dental instrument unit which attempts to solve the problems, discussed above is set forth in the Borgelt et al patent U.S. Pat. No. 3,986,263. The Borgelt et al patent discloses a dental instrument delivery system which includes a pair of pivotally interconnected legs mounted at a common pivot point located at the base of a dental chair. Although this construction permits the legs to be moved freely about the chair it is rather cumbersome since the common pivot point is positioned in the area where a dentist or dental assistant usually positions his/her legs.

The dental instrument units disclosed in each of the above-mentioned patents suffers from disadvantages which are solved by the dental instrument unit of the present invention. More particularly, the present invention sets forth a novel dental console which includes two support arms rotatably mounted on a common pedestal. Each support arm comprises a plurality of links which enable the support arms to be conveniently positioned relative to a dental chair.

SUMMARY OF THE INVENTION

It is an object of the present invention to provide a dental console which includes two support arms rotatably mounted on a pedestal.

A further object of the present invention is to provide a work tray positioned on a first support arm and a cuspidor positioned on a second support arm whereby the first and second support arms may be readily positioned adjacent to either the right or left-hand side of a dental chair to enable the console to be used by either a right-handed or a left-handed dentist in less than 8 seconds without necessity of pulling pins or changing bolts.

A still further object of the present invention is to provide a dental console wherein the sources of power, water, vacuum, and other facilities are conveniently positioned within the support arms so as to reduce the external umbilicals which are normally associated with dental instrument units.

Another object of the present invention is to provide a dental console which may be readily positioned next to one of a plurality of dental chairs positioned about the centrally located pedestal of the dental console.

A still further object of the present invention is to provide a dental console which is positioned adjacent to a dental chair but is displaced outwardly therefrom so as to provide an uncluttered area adjacent to the dental chair which may readily accommodate either a right-handed or left-handed dentist and a dental assistant for four handed dentistry.

These and other objects of the present invention are accomplished by providing a dental console which includes two support arms rotatably mounted on a pedestal which is displaced outwardly from a dental chair. Each support arm comprises a plurality of links which enable the support arms to be conveniently positioned relative to the dental chair. A first support arm includes a work tray with a plurality of power driven hand pieces and various other hand pieces mounted thereon. A second support arm includes a cuspidor having various equipment, such as an air and water syringe, evacuator, saliva ejector, central vacuum, main drain, cup filler and hydrocolloid inlet and outlet mounted thereon. The first support arm and the second support arm may be easily rotated so as to position the work tray and cuspidor, respectively, on either the right-hand side of the left-hand side of the dental chair. In this manner, the dental console of the present invention may be readily used by either a right-handed dentist or a left-handed dentist. Further, the dental console of the present invention may be readily positioned next to one of a plurality of dental chairs positioned about the pedestal of the dental console mounted adjacent to a wall or centrally positioned in a room.

Further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow and the accompanying drawings which are given by way of illustration only, and thus are not limitative of the present invention, and wherein.

DETAILED DESCRIPTION OF THE INVENTION

The present invention is directed to a dental console which may be positioned adjacent to a dental chair but outwardly displaced therefrom so as to provide adequate room for a dentist and a dental assistant to position themselves adjacent to the dental chair. Further, the present invention includes a first support arm and a second support arm which are rotatably mounted on a pedestal so that a work tray and a cuspidor may be conveniently positioned relative to a dental chair for use by either a left-handed dentist or a right-handed dentist.

Figure 1:
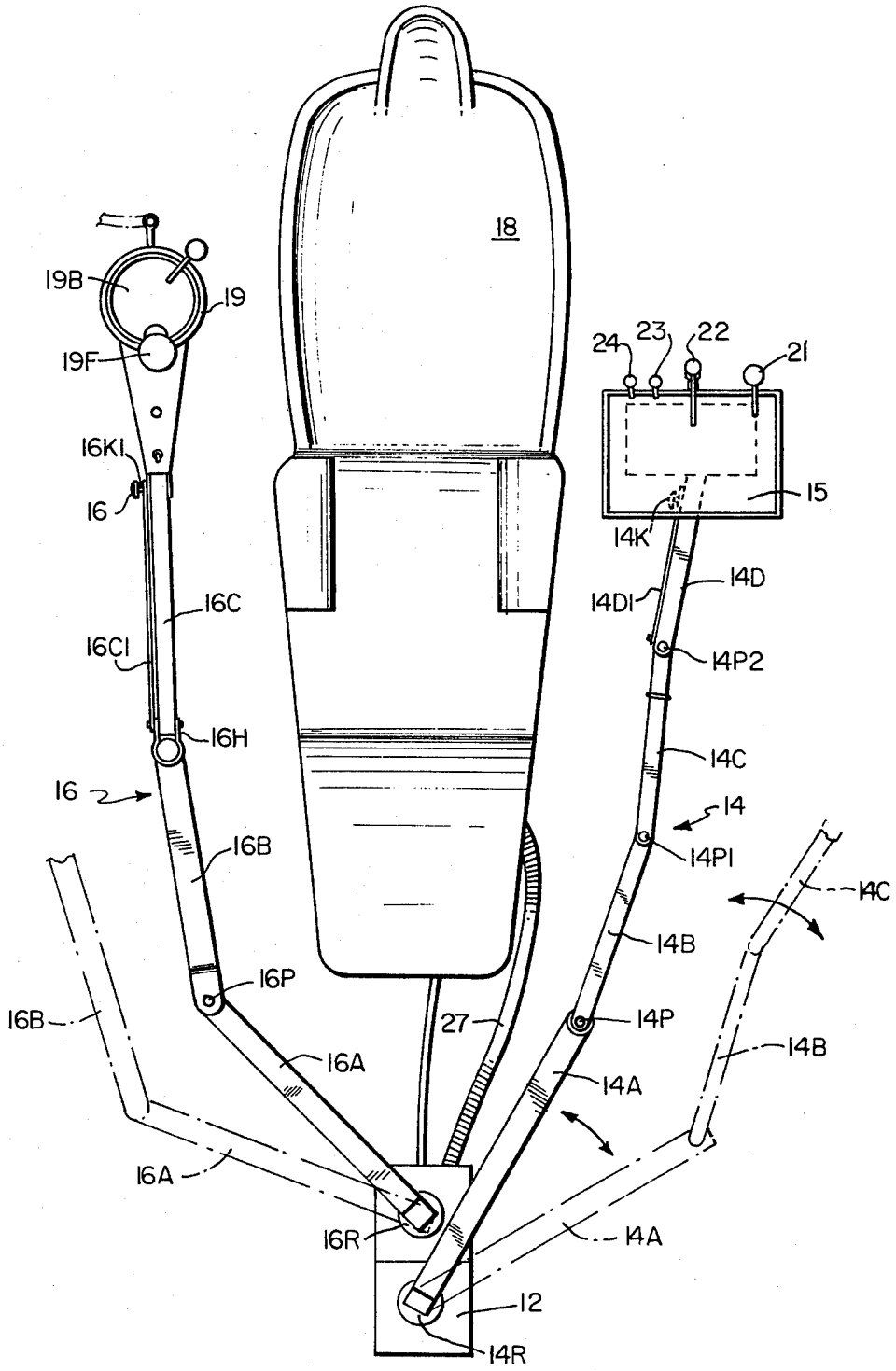
FIG. 1 illustrated a plan view of the dental console of the present invention showing a first position of the support arms in solid lines and a displaced position of the support arms in dotted lines.
Figure 2:
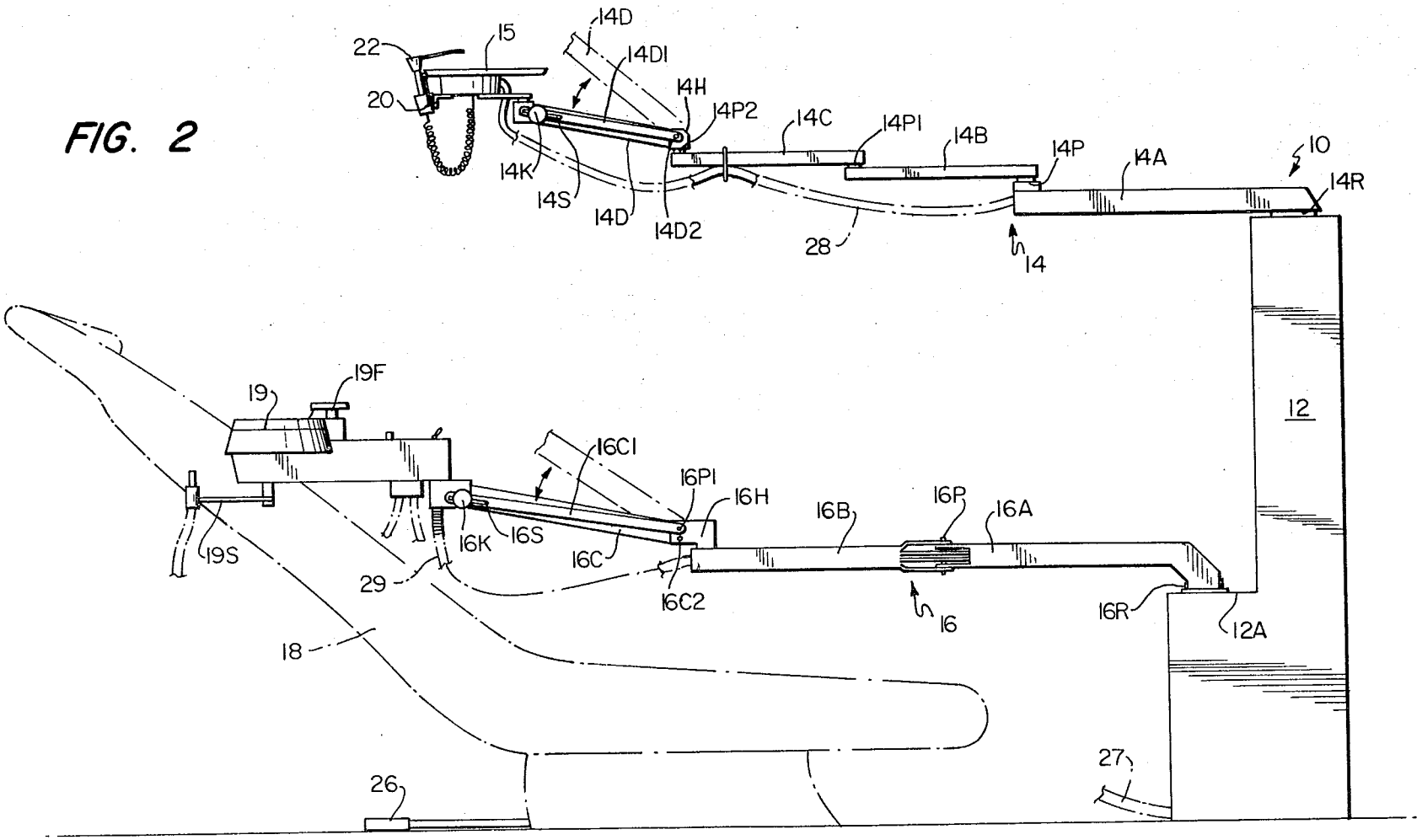
FIG. 2 illustrates a side elevational view of the dental console as illustrated in FIG. 1.
Figure 3:
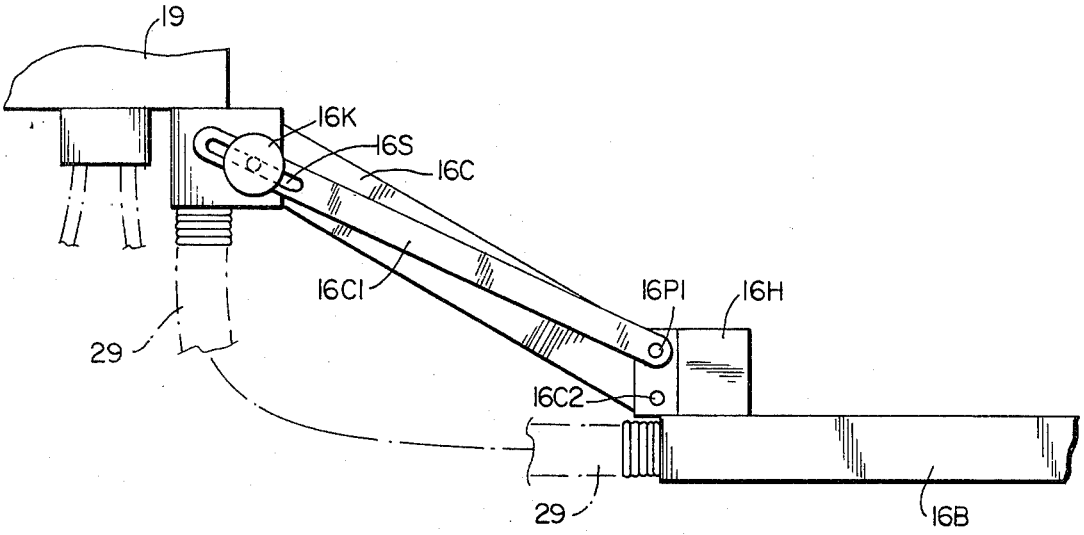
FIG. 3 illustrates an enlarged side view of a vertically adjustable member positioned on the second support arm.

As illustrated in FIGS. 1-3, the dental console of the present invention is generally indicated by character 10. The dental console includes a pedestal 12 which has rotatably mounted thereon a first support arm 14 and a second support arm 16. The first support arm 14 is rotatably mounted by member 14R to the upper portion of the pedestal 12. The second support arm is rotatably mounted by member 16R to an intermediate member of the pedestal 12.

The first support arm 14 includes a plurality of links 14A, 14B, 14C, and 14D which are rotatably mounted relative to each other so as to permit the precise positioning of the work tray 15 relative to a dental chair 18. As illustrated in FIGS. 1 and 2, the link 14B is rotatably mounted to the link 14A by the pin 14P. In addition, the link 14C is rotatably mounted adjacent to the link 14B by means of the pin 14P1. Further, the link 14D is rotatably mounted adjacent to the link 14C by means of the pin 14P2. As illustrated in FIG. 2, the link 14D is pivotally mounted to the housing 14H and is designed to be vertically adjustable relative to the link 14C. The link 14D includes an additional rod 14D1 mounted adjacent thereto and a spring mounted interiorly thereof (not shown). The knob 14K may be rotated so as to loosen the relative position between the rod 14D1 and the link 14D. The knob 14K is mounted on a threaded pin which is slidably received within the slot 14S. By rotating the knob 14K an individual may vertically move the link 14D to any desired position. The spring mounted within the link 14D ensures that the link will fall due to the weight of the tray 15 positioned at one end of the link. The rod 14D1 is pivoted about a pin 14D2 and will move together with the link 14D. After an individual has accurately positioned the link 14D the knob 14K is rotated so as to fix the relative position of the rod 14D1 relative to the link 14D.

The first support arm 14 includes a work tray 15 mounted adjacent to the outermost end thereof. As illustrated in FIG. 1, the work tray 15 includes a work surface on which various dental instruments may be positioned. A holder 20 is mounted adjacent to the work tray 15 for retaining a plurality of hand pieces 21-24. The hand piece 21 is a high speed drill. The hand piece 22 is an additional high speed drill. The hand piece 23 is a slow-speed hand piece while the hand piece 24 is a water and air syringe. The hand pieces 21-23 are powered either electrically, hydraulically, or pneumatically. The dental console of the present invention includes a foot control 26 connected through a transmission line 27 for operating the hand pieces mounted on the work tray 15.

In a preferred embodiment of the present invention, the facilities, such as air, vacuum, water, and a source of power, are positioned within a conduit 28 so as to reduce the umbilicals associated with the dental console. The conduit 28 may be positioned in close proximity to the links 14B, 14C, and 14D. As illustrated in FIG. 2, the conduit 28 is designed to be retained within the link 14A. As is conventional in a dental console unit, the pedestal 12 includes a plurality of facilities which are connected to the facilities positioned within the conduit 28.

As illustrated in FIGS. 1 and 2, the second support arm 16 includes a plurality of links 16A, 16B, and 16C which are rotatably mounted relative to each other. The link 16B is rotatably mounted relative to the link 16A by means of a pin 16P. The link 16C is rotatably mounted relative to the link 16B by means of a housing 16H. Further, the link 16A is rotatably mounted by member 16R to an intermediate portion 12A of the pedestal 12.

As illustrated in FIGS. 2 and 3, the link 16C includes a rod 16C1 pivotally mounted at 16P1 to the housing 16H. In addition, the link 16C is pivotally mounted at 16C2 to the housing 16H. The link 16C permits vertical adjustments of the cuspidor 19 positioned at the outermost end of the link. The cuspidor 19 is vertically adjusted by rotating the knob 16K to permit relative motion between the link 16C and the rod 16C1. The knob 16K is mounted on a threaded pin 16K1 which is positioned within a slot 16S. This arrangement permits movement between the rod 16C1 relative to the link 16C. After an individual has positioned the cuspidor 19 at the desired vertical height, he would merely tighten the knob 16K to fix the rod 16C1 relative to the link 16C and therefore fix the vertical height of the cuspidor. Positioned within the link 16C is a spring (not shown) which stabilizes the vertical positioning of the cuspidor 19 during adjustment.

The cuspidor 19 includes a bowl 19B which is supplied with a source of fluid, such as water, through the member 19F. Fluid supplied to the bowl 19B is drained therefrom by means of a vacuum line and/or gravity drain (not shown) which is connected to the bowl 19B and is positioned within a conduit 29. The conduit 29 is designed to be mounted within the links 16B and 16A to reduce the number of umbilicals of the dental console. The conduit 29 includes a plurality of facilities, such as water, vacuum, air and a drain conduit. The facilities positioned within the conduit 29 are operatively connected to facilities positioned within the pedestal 12.

As illustrated in FIG. 2, the cuspidor includes a support 19S which is adapted to receive a hand piece, such as an air and water syringe, evacuator and saliva ejector. Further, an area is provided adjacent to the cuspidor for supporting a water cup. The instruments positioned on the cuspidor are usually employed by a dental assistant.

Figure 4:
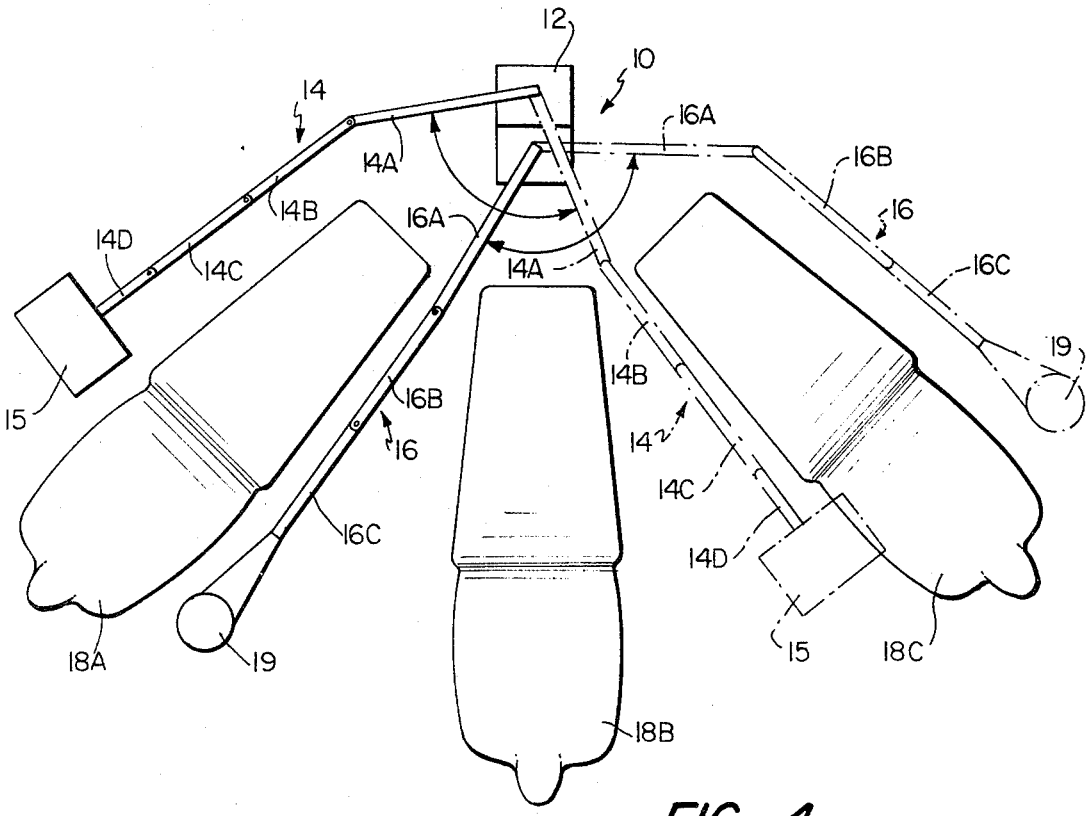
FIG. 4 illustrates a plan view of a second embodiment of the present invention wherein the dental console is readily positioned adjacent to one of plurality of dental chairs positioned about the centrally located pedestal of the dental console.

FIG. 4 illustrates another embodiment of the present invention wherein the dental console 10 may be positioned adjacent to one of a plurality of dental chairs. In this embodiment the dental chairs 18A, 18B and 18C are positioned adjacent to and outwardly displaced from the common pedestal 12. The first support arm 14 is schematically illustrated positioned adjacent to the left-hand side of the dental chair 18A. The second support arm 16 is schematically illustrated positioned adjacent to the right-hand side of the dental chair 18A. In dotted lines the first support arm 14 and the second support arm 16 are positioned adjacent to the third dental chair 18C.

The arrangement illustrated in FIG. 4 is extremely desireable in view of the high cost of dental consoles. A centrally mounted console 10 including a pedestal 12 with an elongated first support arm 14 and a second support arm 16 may easily be utilized to service three or more separate dental chairs. In this manner, a dentist would merely be required to purchase a single dental console and position it in a room so that a number of dental chairs may be placed in close proximity thereto. Therefore, the dental console 10 of the present invention would greatly reduce the investment necessary to furnish a dental office.

The arrangement illustrated in FIG. 4 is extremely adaptable for use by an orthodontist. As is customary in orthodontic practice, an orthodontist may be required to make a number of minor adjustments to the braces of a patient during one office visit. Prior to the present invention, an orthodontist would be required to adjust the braces of a patient in one room and thereafter go to a second and third room to perform similar services to other patients. The dental console of the present invention enables an orthodontist to remain in a single room and adjust braces or perform other services without the necessity of goings from room to room. Therefore this embodiment of the present invention greatly increases the productivity of a dentist since he/she will not lose time by relocating each time a patient must be examined. Further, in this embodiment of the present invention curtains may be positioned between the dental chairs 18A, 18B and 18C to ensure the privacy of the patients.

OPERATION OF THE PREFERRED EMBODIMENT

As illustrated in FIG. 1, the first support arm 14 may be readily rotated from the position illustrated in solid lines to the position illustrated in dotted lines. In addition, the second support arm 16 may be readily rotated from the position illustrated in solid lines to the position illustrated in dotted lines. In this illustration of the present invention the tray 15 is positioned adjacent to the left-hand side and the cuspidor is positioned adjacent the right-hand side of the dental chair 18. In this arrangement of the present invention the hand pieces 21–24 may be readily employed by a left-handed dentist. A left-handed dentist would position himself or herself adjacent to the left-hand side of the dental chair 18 and would easily be able to reach the hand pieces 21–24 positioned on the work tray 15. The right hand of the dentist may be positioned around the patient's head in order to utilize instruments typically used by the dentist. A dental assistant may be positioned adjacent to the right-hand side of the dental chair 18 to aid the dentist in treating the patient.

Although not illustrated in the drawings, the first support arm 14 may be readily rotated adjacent to the right-hand side of a dental chair and a cuspidor may be readily rotated adjacent to the left-hand side of the dental chair. In this arrangement, the dental console 10 of the present invention may be readily utilized by a right-handed dentist to his advantage over normal right-handed units because of the extreme flexibility of this console. The hand pieces 21–24 would be conveniently positioned adjacent to the right hand of the dentist. In addition, the left hand of the dentist may be positioned around the patient's head in order to utilize instruments typically used by a dentist. A dental assistant would be positioned adjacent to the left-hand side of the dental chair to aid the dentist in treating the patient.

The positioning of the dental tray 15 adjacent to the right-hand side of the dental chair is easily accomplished by merely rotating the first support arm 14 about the connection member 14R mounted adjacent to the top portion of the pedestal 12. Similarly, the cuspidor may be readily positioned adjacent to the left-hand side of the dental chair 18 by merely rotating the second support arm 16 about the rotary connection member 16R mounted adjacent to an intermediate portion 12A of the pedestal 12. After the first and second support arms are positioned adjacent to the appropriate side of the dental chair, the work tray 15 and the cuspidor 19 may be vertically adjusted relative to the chair by adjusting the knobs 14K, 16K as discussed hereinabove. As illustrated in FIG. 2, the vertical adjustment of the work tray 15 and the cuspidor 19 is partially illustrated in dotted lines.

An important aspect of the present invention is the reduction of the umbilicals which are customarily associated with dental consoles. As illustrated in FIGS. 1 and 2, the conduits 28 and 29 provide housings for a plurality of various service lines which are connected to the work tray 15 and the cuspidor 19. The conduit 28 is designed to be positioned within the link 14A of the first support arm. Similarly, the conduit 29 is designed to by positioned within the links 16A and 16B of the second support arm. In addition, adjacent to the base of the dental chair is a single transmission line 27 connected to the foot control 26. Therefore, the positioning of the service lines within the conduits 28 and 29 and by providing a single transmission line 27 greatly reduces the umbilicals associated with the dental console of the present invention.

The invention being thus described, it will be obvious that the same may be varied in many ways. Such variations are not to be regarded as a departure of the spirit and scope of the invention, and all such modifications as would be obvious to one skilled in the art are intended to be included within the scope of the following claims.

It is claimed:

1. A dental console including first and second support members adapted to be interchanged relative to each side of a dental chair permitting the console to be readily used by either a right-handed or left-handed individual comprising:

a first support member;

a substantially elongated first support arm for rotatably supporting said first support member, said first support arm being rotatably mounted adjacent to and outwardly displaced from a portion of a dental chair where a patient would position his/her feet;

said substantially elongated first support arm including a plurality of links rotatably mounted relative to each other and an outermost link being mounted for rotatable and vertical adjustment for vertically adjusting said first support member;

said first support member including a work tray and a plurality of hand pieces mounted at an outermost end of said first support arm;

a second support member;

a substantially elongated second support arm for rotatably supporting said second support member, said second support arm being rotatably mounted adjacent to and outwardly displaced from said portion of said dental chair where a patient would position his/her feet;

said substantially elongated second support arm including a plurality of links rotatably mounted relative to each other and an outermost link being mounted for rotatable and vertical adjustment for vertically adjusting said first support member;

said second support member including a cuspidor and a second plurality of hand pieces mounted at an outermost end of said second support arm;

said substantially elongated first support arm being mounted on a common pedestal with said substantially elongated second support arm at a position above said second support arm, said second support arm being positioned to provide a gravity return for water supplied to said cuspidor;

said first and second support members being readily rotated to interchange the positioning of said first and second support members relative to each side of said dental chair, whereby said first support member may be positioned adjacent to one side of said dental chair and said second support member may be positioned adjacent to the other side of said dental chair while leaving an uncluttered area adjacent to a head portion of said dental chair.

2. A dental console according to claim 1, wherein said hand pieces are supplied with various individual facilities which are positioned within a common conduit to reduce the number of umbilicals.

3. A dental console according to claim 1, wherein said second plurality of equipment is supplied with various individual facilities which are positioned within a second common conduit to reduce the number of umbilicals.

4. A dental console according to claim 1, wherein said first support arm being positioned on an upper portion of said common pedestal and said second support arm being positioned on an intermediate portion of said common pedestal.

5. A dental console according to claim 1, wherein said first and second support members are rotatably supported to be interchanged relative to each side of a plurality of dental chairs.

* * * * *